United States Patent [19]

Schiffer et al.

[11] 3,950,802

[45] Apr. 20, 1976

[54] PROCESS OF CONTINUOUSLY WASHING TEXTILE WEB

[75] Inventors: Günter Schiffer, Krefeld-Bockum; Karl Peter Lopata, Krefeld, both of Germany

[73] Assignee: Kleinewefers Industrie Companie GmbH, Germany

[22] Filed: July 13, 1973

[21] Appl. No.: 379,076

[30] Foreign Application Priority Data

July 20, 1972 Germany ..... 2235617

[52] U.S. Cl. ..... 8/149.1; 8/149.3; 8/151; 68/5 D; 68/43; 68/62; 68/181 R; 68/205 R

[51] Int. Cl.[2] ..... D06B 3/02; D06B 21/02

[58] Field of Search ..... 8/149.1, 149.2, 149.3, 8/151, 151.2; 68/5 D, 5 E, 19.1, 62, 175, 181 R, 205 R, 27, 43, 208

[56] References Cited

UNITED STATES PATENTS

| | | | |
|---|---|---|---|
| 1,209,465 | 12/1916 | Matter | 68/5 E |
| 1,682,841 | 9/1928 | Fruh | 68/205 R X |
| 2,539,947 | 1/1951 | De Klerk | 68/62 X |
| 3,064,458 | 11/1962 | Grimes | 68/43 X |
| 3,118,154 | 1/1964 | Osban et al. | 68/5 E X |
| 3,505,835 | 4/1970 | Reggiani | 68/62 X |
| 3,722,233 | 3/1973 | Meier-Windhorst | 68/5 D |

FOREIGN PATENTS OR APPLICATIONS

| | | | |
|---|---|---|---|
| 126,819 | 2/1932 | Austria | 68/205 R |

*Primary Examiner*—Stanley N. Gilreath
*Assistant Examiner*—Philip R. Coe
*Attorney, Agent, or Firm*—Hill, Gross, Simpson, Van Santen, Steadman, Chiara & Simpson

[57] ABSTRACT

The invention relates to a novel process for continuous washing of a textile web in flattened condition by guiding the web along a zig-zag-shaped path over a plurality of guide rolls arranged in two vertical parallel rows in a vessel, while maintaining in said vessel a temperature of at least 100° C and an over-pressure of at least 1 atm., and while subjecting at least one side of the substantially horizontal sections of the web between successive guide rolls to spraying with a wash solution. The invention also includes the apparatus in which said process is carried out.

15 Claims, 1 Drawing Figure

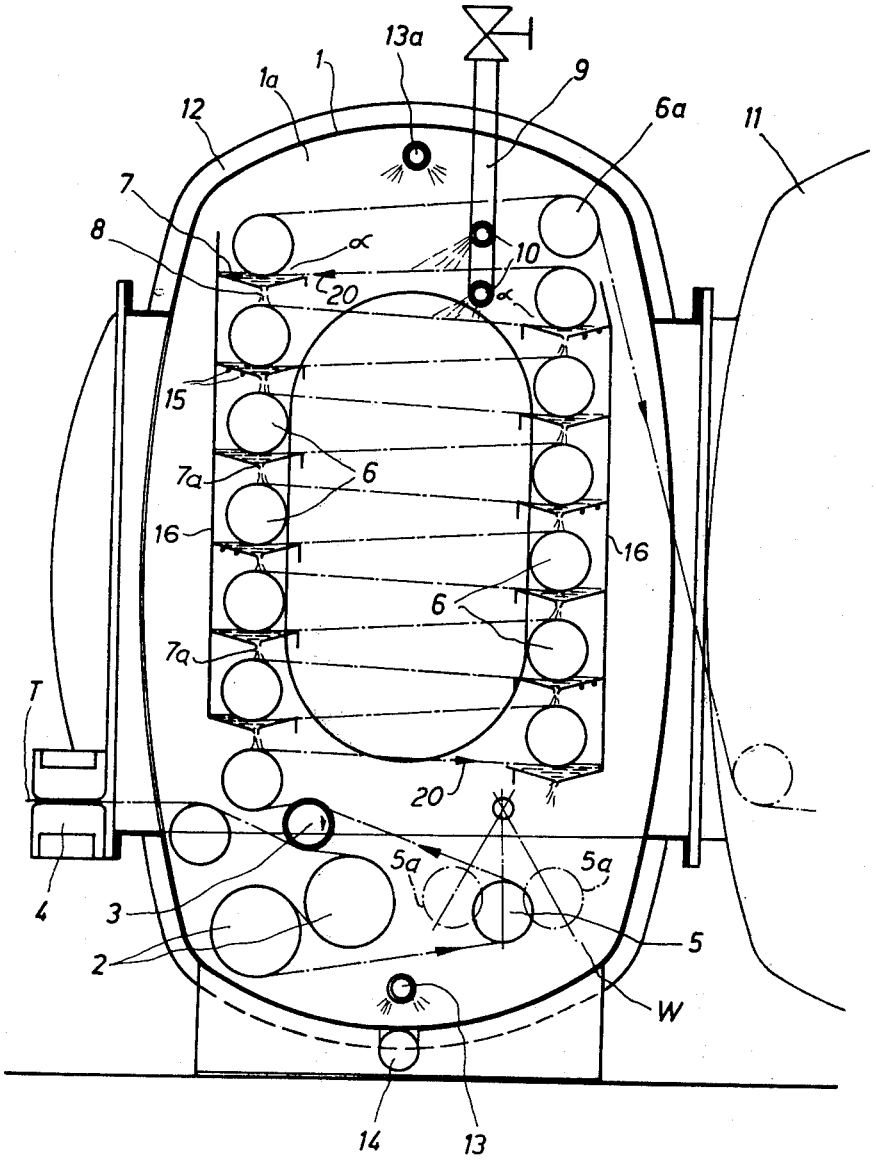
13a
1
1a
9
12
6a
11
7
8
α
10
20
15
7a
6
16
16
6
7a
T
20
5a
5a
4
3
2
5
W
14
13

PROCESS OF CONTINUOUSLY WASHING TEXTILE WEB

This invention relates to a process of continuous washing of a textile web in a flattened or spread-out condition by passing said web successively over a plurality of suitably arranged guide rolls and simultaneously spraying at least one side of sections of the web with a wash solution, while maintaining a controlled atmosphere around the web and guide rolls.

BACKGROUND OF THE INVENTION

Processes for washing of textile webs in their full width are known, in which the textile web in a vessel, or a wash tower, is passed around guide rolls and between said rolls is sprayed with a wash solution on at least one side. In some of said known processes the wash or dye mixture is compressed in the gradually narrowing wedge-shaped interspace between the textile web and the roll surface during the passage of the textile web onto the guide rolls. Thereby said mixture is said to be pressed through the textile web with alleged assistance of the centrifugal force to thus effect the washing procedure.

Other known processes for flat-washing of textile webs provide for winding of the web around guide rolls or vertical immersion of the web into a wash solution and subsequent repeated squeezing of the web with cascade-like further transportation of the wash solution in troughs. Spraying of the web with wash solution and subsequent squeezing is also as well known as the circulation of a wash solution through the web on a drum.

It is a recognized fact that in the known processes the wash solutions are comparatively incompletely utilized.

SUMMARY OF THE INVENTION

Accordingly, it is an object of the present invention to provide a process in which with a given amount of wash solution during a given period of time a higher washing effect is obtainable than in hitherto known washing procedures, which means a better utilization of the wash mixture.

For the achievement of this improved effect it is another object of the invention to provide a process in which the textile web during the washing procedure is passed through an air, steam or gas atmosphere of at least about 100° C temperature and super-atmospheric pressure which latter preferably corresponds to the temperature used in the pressure-tight treatment vessel.

The general consideration underlying the invention is that in textile goods, and particularly in heavier textile material, the embedded tiny air bubbles and the surface tension of the wash solution on the web prevent intensive penetration of the wash solution through the textile material. Through the passage of the textile web through an atmosphere of predetermined high temperature and super-atmospheric pressure, said air bubbles are expelled and said surface tension is rendered ineffective to such an extent that the wash solution can readily and speedily penetrate into and through the texture of the textile web.

The process according to the invention leads to an especially excellent result if the wash solution in a manner known per se is compressed in the narrowing wedge-shaped interspace between textile web and roll surface in the passage of the textile web onto the guide roll. Through the forcing of the wash solution through the tissue of the textile web the tiny air bubbles still remaining between the fibers of the textile web are together with the wash solution forcibly expelled and/or the evaporation of said bubbles and the elimination or relaxation of said surface tension are promoted. The same effect can also be achieved in other ways if provisions are made for forcibly pressing the wash solution through the texture.

In further development of the inventive process the textile web is during part of its passage around the guide rolls immersed in the wash solution, which preferably is additionally heated before or during the washing procedure.

Another object of the invention is to provide a wash tower for the carrying out of the novel process, in which in the case of horizontal or substantially horizontal passage of the textile web parallel vertical rows of guide rolls together with spray tubes for the wash solution are arranged in a pressure-tight container, or vessel, which also is provided with a supply conduit for steam or hot air and with wash solution inlet and outlet conduits as well as with control means for maintenance of the super-atmospheric pressure and the temperature of 100° C, or more, inlet and outlet sealing means for the textile web also being provided.

A further object of the invention is to provide an arrangement in which the guide rolls are disposed in two rows in which the rolls are mutually offset, and all or some of the rolls may dip into catch troughs disposed beneath said rolls, so that the textile web in moving around such rolls is immersed in the wash solution accumulated in the troughs. The wash solution in the individual troughs may be passed on to the section of the textile web winding its way about the next lower roll.

Still another object of the invention is to provide a container with means for heating the wash solution before and after its passage through the container.

BRIEF DESCRIPTION OF THE DRAWING

A preferred embodiment of the inventive wash tower is described below with reference to the accompanying diagrammatic drawing in which the single FIGURE shows a vertical section through a vessel in which the process according to the invention may be advantageously carried out.

DESCRIPTION OF THE PREFERRED EMBODIMENT

The wash tower according to the invention includes a vessel 1 having therein a closed chamber 1a in which a pair of intake rolls 2 are mounted and adapted to pull a textile web T into the vessel for passage over a flattening roll 3. On the inlet side the vessel 1 is provided with sealing means 4 of conventional type for the web T. Between said intake rolls 2 and the flattening roll 3 there is provided a tension compensator 5 which is pivotable between the positions shown in dotted lines at *5a* in the drawing in order to control the tension of the textile web T.

In the middle and upper portions of the vessel 1 two laterally spaced series of vertically spaced guide rolls 6 are mounted over which the textile web T travels in generally zig-zag fashion progressively upwardly, as indicated by the arrows 20 so that successive sections of the web extend substantially horizontally in traveling between the series of rolls. In association with each guide roll 6 and below the same there is a catch trough 7 for the wash solution, and at the lowest point of each of said troughs there are provided outlet openings 7*a* through which the wash solution may escape down onto the section of the textile web winding its way about the next lower guide roll 6, as indicated at 8.

A wash solution supply pipe 9 extends through the top of the vessel 1 and is provided with spray tubes 10 arranged in parallel with the rolls 6. Preferably there are two of said supply pipes 9 arranged between the rows of rolls in the upper part of the chamber 1a and connected by means of the spray tubes 10 at the levels of one or more of said guide rolls adjacent to the tops of the series of rolls. Through said spray tubes 10 preferably preheated wash solution is sprayed onto the textile web T. The arrangement of the spray tubes 10 is preferably such that the wash solution is sprayed from above onto the sections of the web extending between two of the rolls 6, one in each of said vertical rows of guide rolls, and that the spray solution travels generally downwardly countercurrent to the generally upward progress of the web and is carried into the wedge-shaped interspace between the web T and the roll surface. It will therefore be observed that each successive web section below the washing liquid supplying means 9, 10 is washed with the washing liquid as the liquid progressively descends from section-to-section of the generally upwardly traveling web.

The textile web T is guided over the top roll 6*a* and passes from the vessel 1 into another vessel 11 of the same or similar kind, or it may be guided out of the vessel 1 through sealing means similar to the sealing means 4.

The vessel 1 is a pressure container and the sealing means 4 as well as corresponding sealing means (not shown) at the outlet from the vessel 1 or from the adjacent vessel 11 are such as to provide sufficient tightness to permit the maintenance of a pressure in excess of one atmosphere in the vessel. The vessel 1 is further provided with a heat insulating cover 12 which makes it possible to maintain in the vessel a temperature of at least 100° C. Through a conduit 13 or 13*a* steam or hot air is supplied to the vessel 1 in order to maintain said temperature therein. The maintenance of said temperature may also be accomplished by other means (not shown).

The bottom portion of the vessel 1 is formed as a trough or sump in which the wash solution W accumulates and may be discharged through a conduit 14. As indicated in the drawing, the incoming textile web T is guided through said accumulated wash solution below the series of rolls 6 by the intake rolls 2 and the tension compensator 5.

The wash solution introduced through the pipe 9 may be preheated, and in connection with the troughs 7 heating means 15 may be provided for intermediary heating of said solution.

Since in comparison with the known processes the wash solution according to the invention is passed, i.e. pressed, at higher speed and more frequently through the web being guided over the rolls 6, the troughs 7 are provided at their outer edges with splash walls 16, as indicated. Accordingly, the wash solution penetrating through said sections of the textile web is immediately passed on to a trough and its heating means without being transferred a considerable distance through a sump at the bottom of the vessel 1 and conventional pump conduits.

Modifications of the apparatus shown in the drawing may be made within the scope of the appended claims.

We claim:

1. A process of continuously washing textile web, comprising the steps of:

guiding a textile web in a closed wash tower chamber to travel in generally zig-zag fashion progressively upwardly between laterally spaced series of vertically spaced guide rolls within the chamber so that successive sections of said web extend substantially horizontally in traveling between the series of rolls;

supplying washing liquid onto the web in the upper part of the chamber adjacent to the tops of said series of rolls to travel generally downwardly countercurrent to the generally upward progress of the web; and successively washing each web section below said supplying of washing liquid with said washing liquid, comprising collecting and concurrently pressing the liquid successively through the web sections as the liquid progressively descends from section-to-section of the traveling web.

2. A process according to claim 1, comprising maintaining within the tower chamber a temperature of at least 100°C and a superpressure of at least one atmosphere.

3. A process according to claim 1, including the step of collecting and pressing the washing liquid into and through the web sections as they run into engagement with the respective rolls whereby to improve the washing effect of the descending liquid.

4. A process according to claim 1, including the step of preheating the web.

5. A process according to claim 1, including the step of preheating said washing liquid.

6. A process according to claim 1, including maintaining a saturated atmosphere temperature relationship with the washing liquid in said tower chamber.

7. A process according to claim 1, including tensioning said web in said chamber below said series of rolls.

8. A process according to claim 1, including introducing an atmosphere-heating medium into the upper portion of said tower chamber.

9. A process according to claim 1, including introducing an atmosphere heating medium into the lower portion of said tower chamber.

10. A process according to claim 1, including guiding the descending washing liquid to travel downwardly over said rolls and through said web sections.

11. A process according to claim 1, including guiding the descending washing liquid to travel onto the off-running sides of the rolls and into bights between the web sections and the on-running sides of the rolls, whereby the liquid is squeezed through the web as the web sections run onto the rolls.

12. A process of continuous washing of textile web, comprising:

introducing a textile web into the lower portion of a wash tower chamber through a pressure seal;

from the lower portion of the chamber guiding the web to travel progressively upwardly within the chamber in generally zig-zag fashion over and between laterally spaced series of vertically spaced guide rolls within the chamber so that successive sections of the web extend generally horizontally in traveling between the series of rolls;

in the upper portion of the chamber supplying washing liquid to the web in the upper portion of the chamber and adjacent to the tops of said series of rolls for travel of the washing liquid generally downwardly countercurrent to the generally upward progress of the web;

guiding the descending washing liquid to travel successively downwardly from roll-to-roll and progressively through the successive ascending web sections;

maintaining a saturated atmosphere of at least 100°C and a super-pressure of at least one atmosphere within said chamber;

transferring the washed web out of the chamber from the upper portion of said chamber; and removing spent washing liquid from the bottom of said chamber.

13. A process of continuously washing textile web, comprising the steps of:

guiding a textile web in a closed wash tower chamber to travel in generally zig-zag fashion progressively upwardly between laterally spaced series of vertically spaced guide rolls within the chamber so that successive sections of said web extend substantially horizontally in traveling between the series of rolls;

supplying washing liquid to the web in the upper part of the chamber adjacent to the tops of said series of rolls to travel generally downwardly countercurrent to the generally upward progress of the web; and successively washing each web section below said supplying of washing liquid with said washing liquid as the liquid progressively descends from section-to-section of the traveling web, including the step of collecting washing liquid at the undersides of said guide rolls and dipping said textile web sections in said washing liquid as the sections travel into engagement with the rolls.

14. A process of continuously washing textile web, comprising the steps of:

guiding a textile web in a closed wash tower chamber to travel in generally zig-zag fashion progressively upwardly between laterally spaced series of vertically spaced guide rolls within the chamber so that successive sections of said web extend substantially horizontally in traveling between the series of rolls;

supplying washing liquid to the web in the upper part of the chamber adjacent to the tops of said series of rolls to travel generally downwardly countercurrent to the generally upward progress of the web; and successively washing each web section below said supplying of washing liquid with said washing liquid as the liquid progressively descends from section-to-section of the traveling web, comprising collecting the descending washing liquid in troughs below said guide rolls and running the web sections through the liquid in the troughs.

15. A process according to claim 14, including discharging the washing liquid from said troughs through outlets in the bottoms of the troughs onto the tops of respective rolls therebelow and onto the web sections running over the rolls.

* * * * *